US008443723B2

(12) United States Patent
Liu et al.

(10) Patent No.: US 8,443,723 B2
(45) Date of Patent: May 21, 2013

(54) CROSS-STRAPPING DEVICE

(75) Inventors: Chin-Chang Liu, Taichung (TW); Chi-Jan Su, Taipei (TW)

(73) Assignees: Tekpak Corporation, Taichung (TW); Transpak Equipment Corporation, Taipei (TW)

( * ) Notice: Subject to any disclaimer, the term of this patent is extended or adjusted under 35 U.S.C. 154(b) by 322 days.

(21) Appl. No.: 12/912,916

(22) Filed: Oct. 27, 2010

(65) Prior Publication Data

US 2012/0102898 A1 May 3, 2012

(51) Int. Cl.
*B65B 13/04* (2006.01)
*B65B 13/18* (2006.01)

(52) U.S. Cl.
USPC ..... 100/26; 100/19 R; 100/29; 53/589

(58) Field of Classification Search
USPC ..... 100/7, 25, 26, 29, 33 PB, 19 R; 53/589
See application file for complete search history.

(56) References Cited

U.S. PATENT DOCUMENTS

| | | | | |
|---|---|---|---|---|
| 3,031,816 | A * | 5/1962 | Mertens | 53/582 |
| 5,078,057 | A * | 1/1992 | Pearson | 100/25 |
| 5,842,327 | A * | 12/1998 | Schwede | 53/540 |
| 7,086,213 | B2 * | 8/2006 | Stauber | 53/589 |
| 7,428,865 | B1 * | 9/2008 | Kasel et al. | 100/3 |

* cited by examiner

*Primary Examiner* — Jimmy T Nguyen
(74) *Attorney, Agent, or Firm* — Ming Chow; Sinorica, LLC

(57) ABSTRACT

A cross-strapping device includes a base, a lateral strapping mechanism, and a longitudinal strapping mechanism. This base has a working surface. The lateral strapping mechanism has a lateral chute, a first strap supplying assembly, and a first sealing/cutting assembly. A first strap is guided by the lateral chute and is strapped around the object to finish a lateral strapping procedure. The longitudinal strapping mechanism has a longitudinal guider, a second strap supplying assembly, and a second sealing/sealing assembly. A second strap is guided by the longitudinal guider and be strapped around the object to finish a longitudinal strapping procedure. So, this object is placed on a fixed working surface without rotation. The lateral strapping procedure and the longitudinal strapping procedure are completed on the same working surface. Hence, both the lateral strapping procedure and the longitudinal strapping procedure can be done in only one machine. In addition, the turn table is not required.

2 Claims, 10 Drawing Sheets

CROSS-STRAPPING DEVICE

BACKGROUND OF THE INVENTION

1. Field of the Invention

The present invention relates to a cross-strapping device. Particularly, both the lateral strapping procedure and the longitudinal strapping procedure can be done in only one machine. In addition, the turn table is not required.

2. Description of the Prior Art

Referring to FIGS. 1, 2, 3A, 3B, 3C and 3D, when the newspaper or magazine industry needs a cross-strapping work, usually it requires three machines, namely a first strapping machine 81, a turn table 82, a second strapping machine 83.

About the conventional cross-strapping procedure, a package 90 moves from a first position P1 to a second position P2 which is positioned in the first strapping machine 81 for doing the first strapping procedure. Then, a first strap X1 is strapped around the package 90. After which, the package 90 moves to a third position P3 which is positioned on the turn table 82. The turn table turns 90 degrees (from the condition in FIG. 3B into the condition in FIG. 3C). Then, this package 90 moves to a fourth position P4 which is positioned in the second strapping machine 83 for doing the second strapping procedure. After which, this package 90 moves to a fifth position P5. So, a second strap X2 is strapped on package 90. The first strap X1 and the second strap X2 form a cross-strapping. Hence, the conventional cross-strapping procedure is done.

However, the above-mentioned conventional procedure needs three machines. Not only it needs larger space, but also the total cost for three machines is high. In addition, the required moving processes are more so that its processing way is complicated.

In addition, when the package 90 is turned on the turn table 82, this package 90 must be moved to a center of the turn table 82. Otherwise, this package 90 becomes tilted or slightly departing from the center. Once the package 90 departs from the center, it needs a worker to push it back or to adjust its position manually. Besides, if the weight of the package 90 is heavy, definitely it requires more electricity during the turning process. Thus, its energy consuming is higher.

SUMMARY OF THE INVENTION

The object of the present invention is to provide a cross-strapping device. In which, both the lateral strapping procedure and the longitudinal strapping procedure can be done in only one machine. In addition, the turn table is not required. Therefore, it can solve the problems of the conventional cross-strapping procedure such as its processing way is complicated and this package becomes tilted or slightly departing from the center after turning.

In order to achieve above object, this invention is provided. A cross-strapping device comprising:

a base having a working surface, a first end, a second end, the working surface being provided for receiving an object thereon, the object having a top surface, a bottom surface, a front surface, a rear surface, and two sides;

a lateral strapping mechanism having a lateral chute, a first strap supplying assembly, and a first sealing/cutting assembly; the first strap supplying assembly is provided for supplying a first strap which is guided by the lateral chute and be strapped around the object's top surface, bottom surface, and two sides; the first sealing/cutting assembly being used for sealing and cutting the first strap so as to finish a lateral strapping procedure;

a longitudinal strapping mechanism having a longitudinal guider, a second strap supplying assembly, and a second sealing/cutting assembly; the second strap supplying assembly is provided for supplying a second strap which is guided by the longitudinal guider and be strapped around the object's top surface, bottom surface, front surface and rear surface; the second sealing/cutting assembly being used for sealing and cutting the second strap so as to finish a longitudinal strapping procedure;

so that the object is placed on a fixed working surface without rotation, as well as the lateral strapping procedure and the longitudinal strapping procedure are completed on the same working surface.

DETAILED DESCRIPTION OF THE PREFERRED EMBODIMENT

Figure 1:
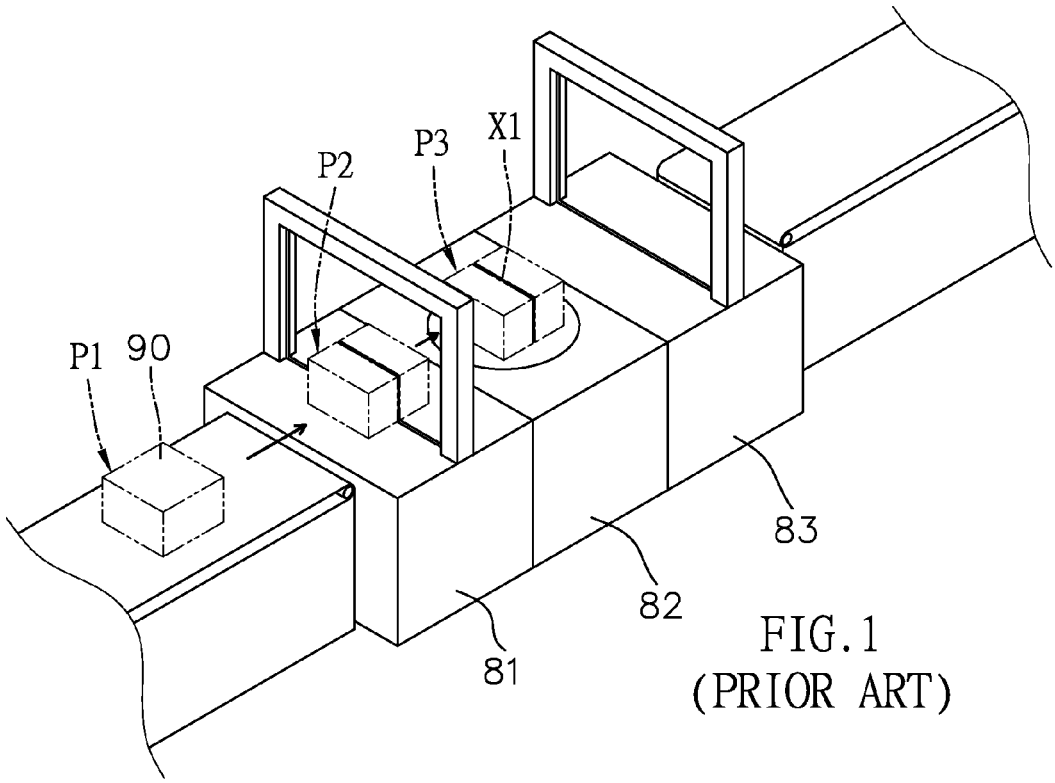
FIG.1 (PRIOR ART)
FIG. 1 is a perspective view showing the first strapping procedure of the conventional apparatus.
Figure 2:
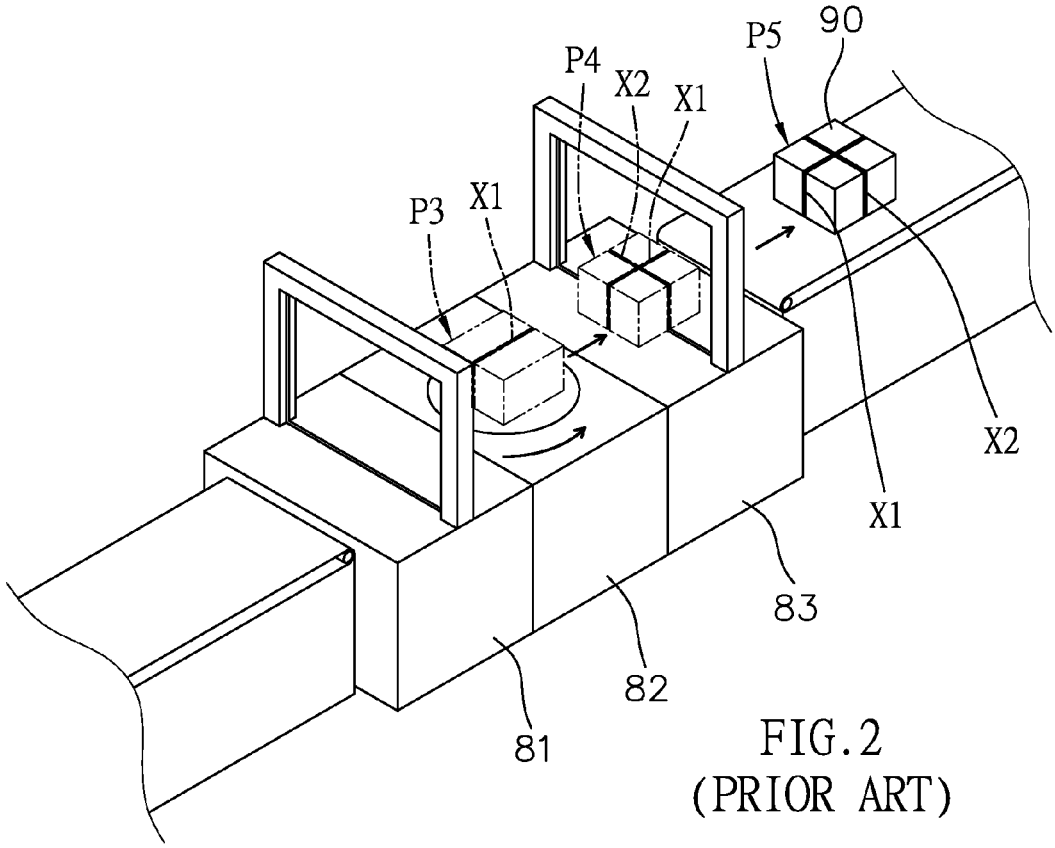
FIG.2 (PRIOR ART)
FIG. 2 is a perspective view showing the 90-degree turning and the second strapping procedure of the conventional apparatus.
Figure 3A:
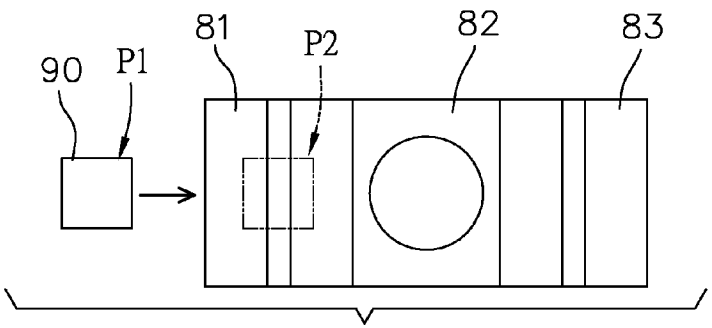
FIG. 3A (PRIOR ART)
FIG. 3A shows the process one of the conventional cross-strapping procedure.
Figure 3B:
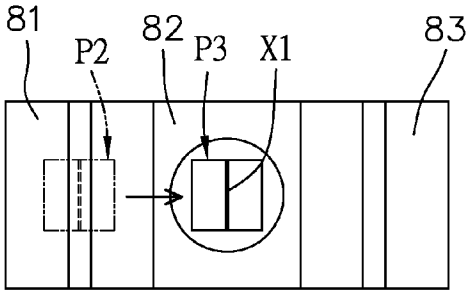
FIG. 3B (PRIOR ART)
FIG. 3B shows the process two of the conventional cross-strapping procedure.
Figure 3C:
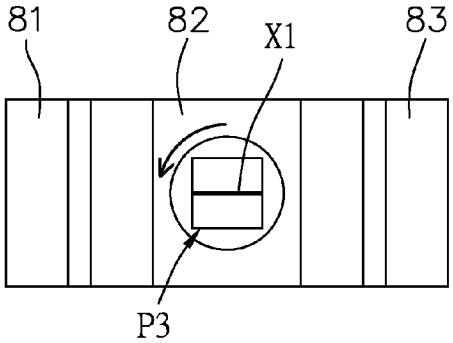
FIG. 3C (PRIOR ART)
FIG. 3C shows the process three of the conventional cross-strapping procedure.
Figure 3D:
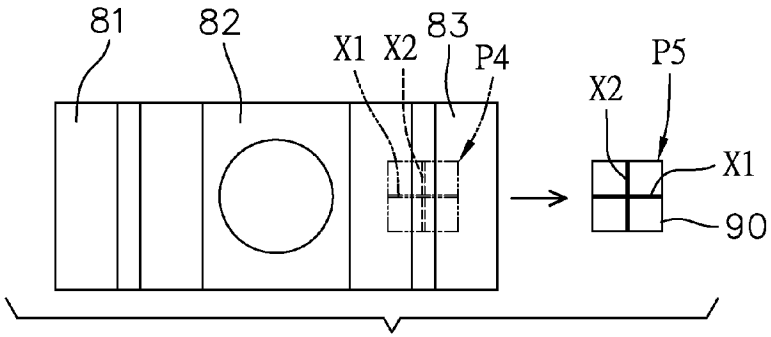
FIG. 3D (PRIOR ART)
FIG. 3D shows the process four of the conventional cross-strapping procedure.
Figure 4:
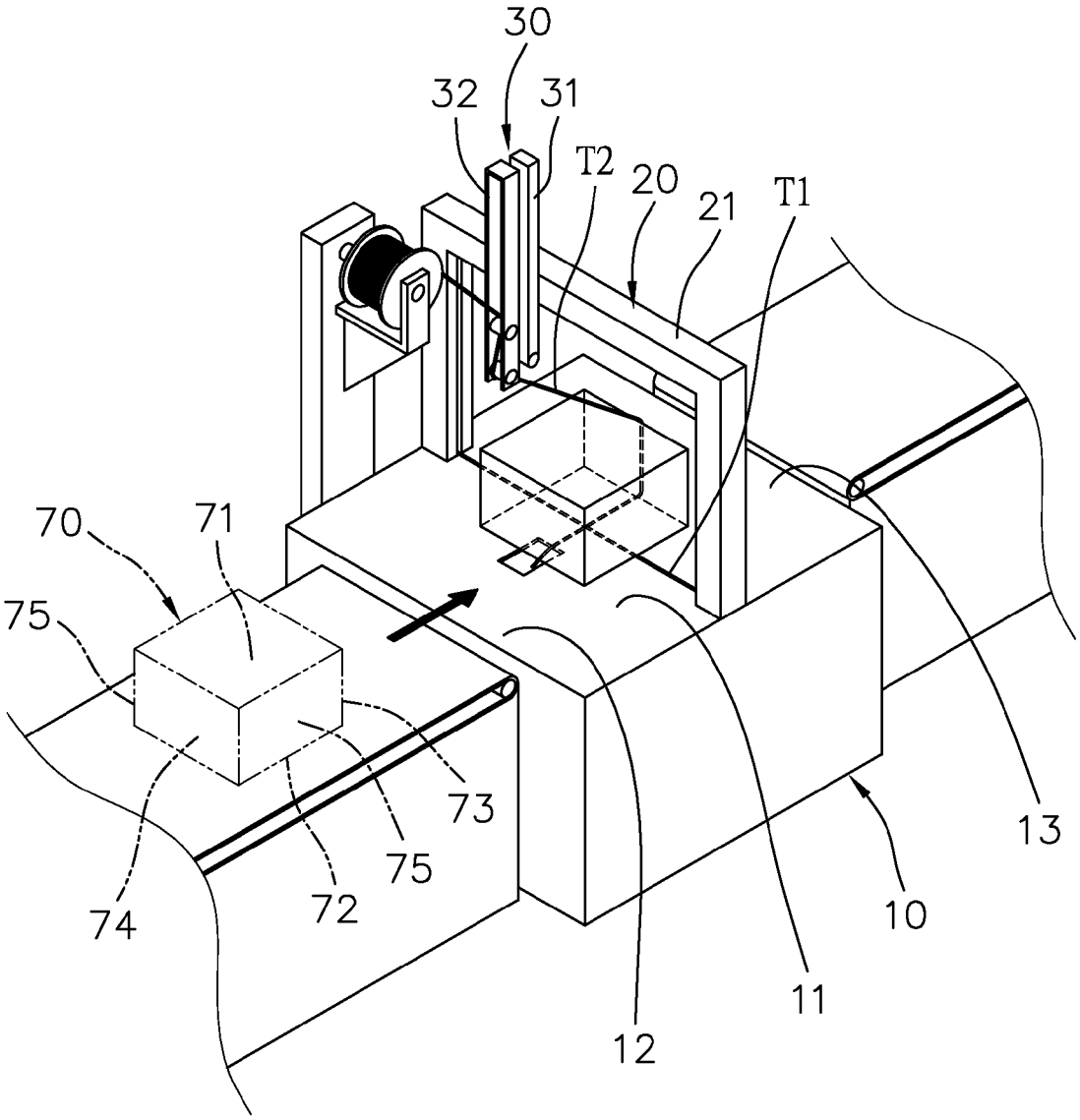
FIG. 4 is a perspective view of the present invention.
Figure 5A:
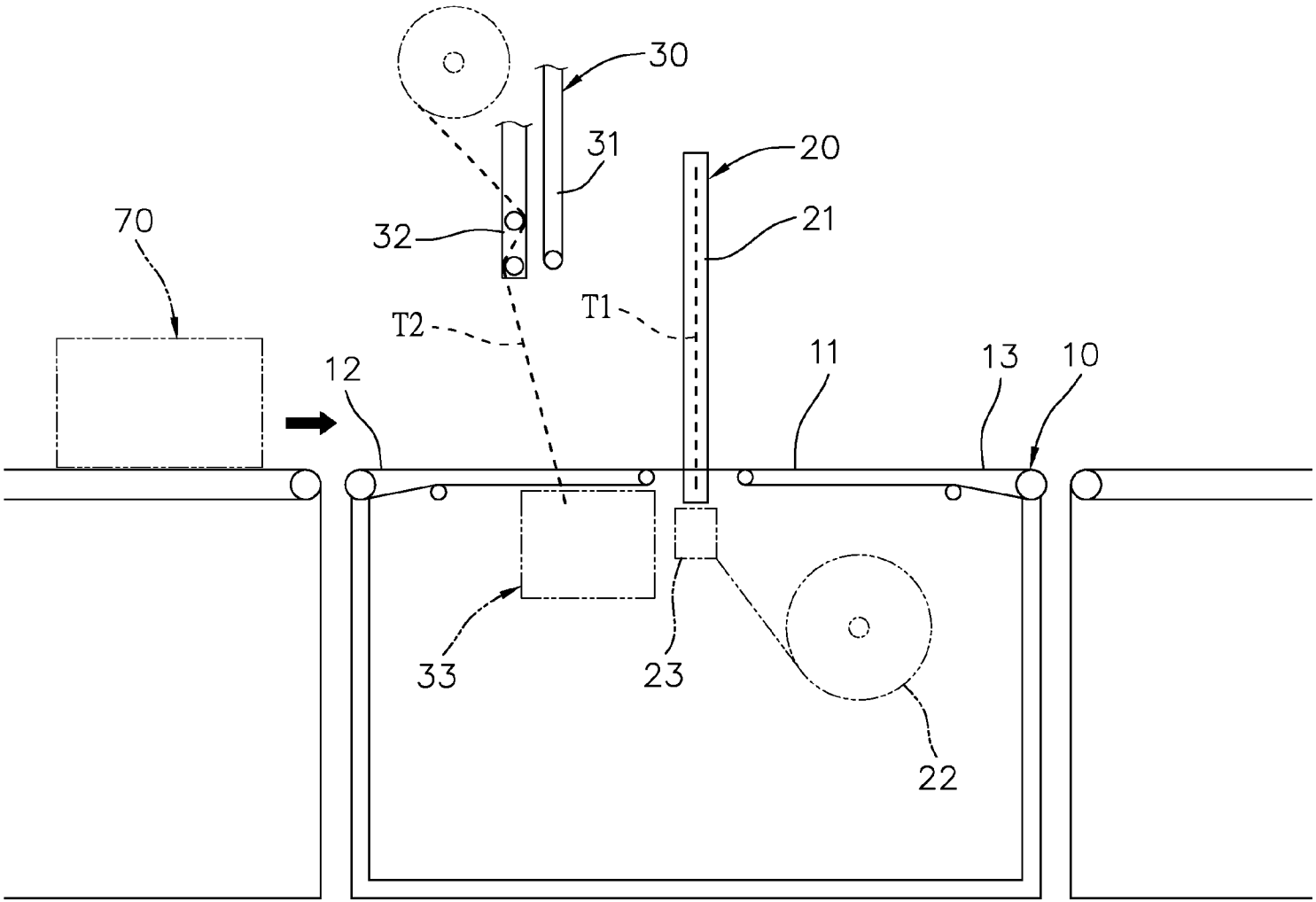
FIG. 5A is a schematic illustration showing the condition before strapping.

Referring to FIGS. 4 and 5A, the present invention is a cross-strapping device. It mainly comprises a base 10, a lateral strapping mechanism 20, and a longitudinal strapping mechanism 30.

With regard to this base 10, it has a working surface 11, a first end 12, and a second end 13. The working surface 11 is provided for receiving an object 70 thereon. This object 70 has a top surface 71, a bottom surface 72, a front surface 73, a rear surface 74, and two sides 75.

Concerning the lateral strapping mechanism 20, it has a lateral chute 21, a first strap supplying assembly 22, and a first sealing/cutting assembly 23. The first strap supplying assembly 23 is provided for supplying a first strap T1 which is guided by the lateral chute 21 and is strapped around the object's 70 top surface 71, bottom surface 72, and two sides 75. The first sealing/cutting assembly 23 is used for sealing and cutting the first strap T1 so as to finish a lateral strapping procedure. The lateral strapping mechanism 20 is a conventional device (having the same operating principle as the traditional first strapping machine and the third strapping machine mentioned previously). So, the description about the movement and operating principle of its detailed components is omitted here.

About the longitudinal strapping mechanism 30, it has a longitudinal guider 31, a second strap supplying assembly 32, and a second sealing/sealing assembly 33. The second strap supplying assembly 32 is provided for supplying a second strap T2 which is guided by the longitudinal guider 31 and be strapped around the object's 70 top surface 71, bottom surface 72, front surface 73 and rear surface 74. The second sealing/cutting assembly 33 is used for sealing and cutting the second strap T2 so as to finish a longitudinal strapping procedure;

so that this object 70 is placed on a fixed working surface 11 without rotation, as well as said lateral strapping procedure and said longitudinal strapping procedure are completed on the same working surface 11.

Furthermore, the longitudinal strapping mechanism 30 comprises a first clamper 331, a second clamper 332, a third clamper 333, a fourth clamper 334, a fifth clamper 335, a transverse guider 336, a cutter 337, and a thermal sealer 338. The first clamper 331 and the second clamper 332 are able to clamp/release an end of the second strap T2. The third clamper 333 and the fourth clamper 334 are able to move into/from a place below the bottom surface 72 of the object 70. The third clamper 333 and the fourth clamper 334 are able to clamp/release a first portion Z1 of the second strap T2. The third clamper 333 and the fifth clamper 335 are able to clamp/release a second portion Z2 of the second strap T2. The transverse guider 336 is provided for guiding the second strap T2 bending below the bottom surface 72 of the object 70 as well as making the second strap T2 having an substantially overlapping portion so as to strap around the object 70. The cutter 337 is used for cutting the second strap T2. The thermal sealer 338 is provided for sealing a part of this overlapped portion so as to seal the second strap T2.

The actual operation process of this invention can be described below.

[a] As illustrated in FIG. 5A, the object 70 which is placed on a conveyor is ready to move in. The second strap T2 is substantially tilted (however it can be vertical or tilted).

Figure 5B:
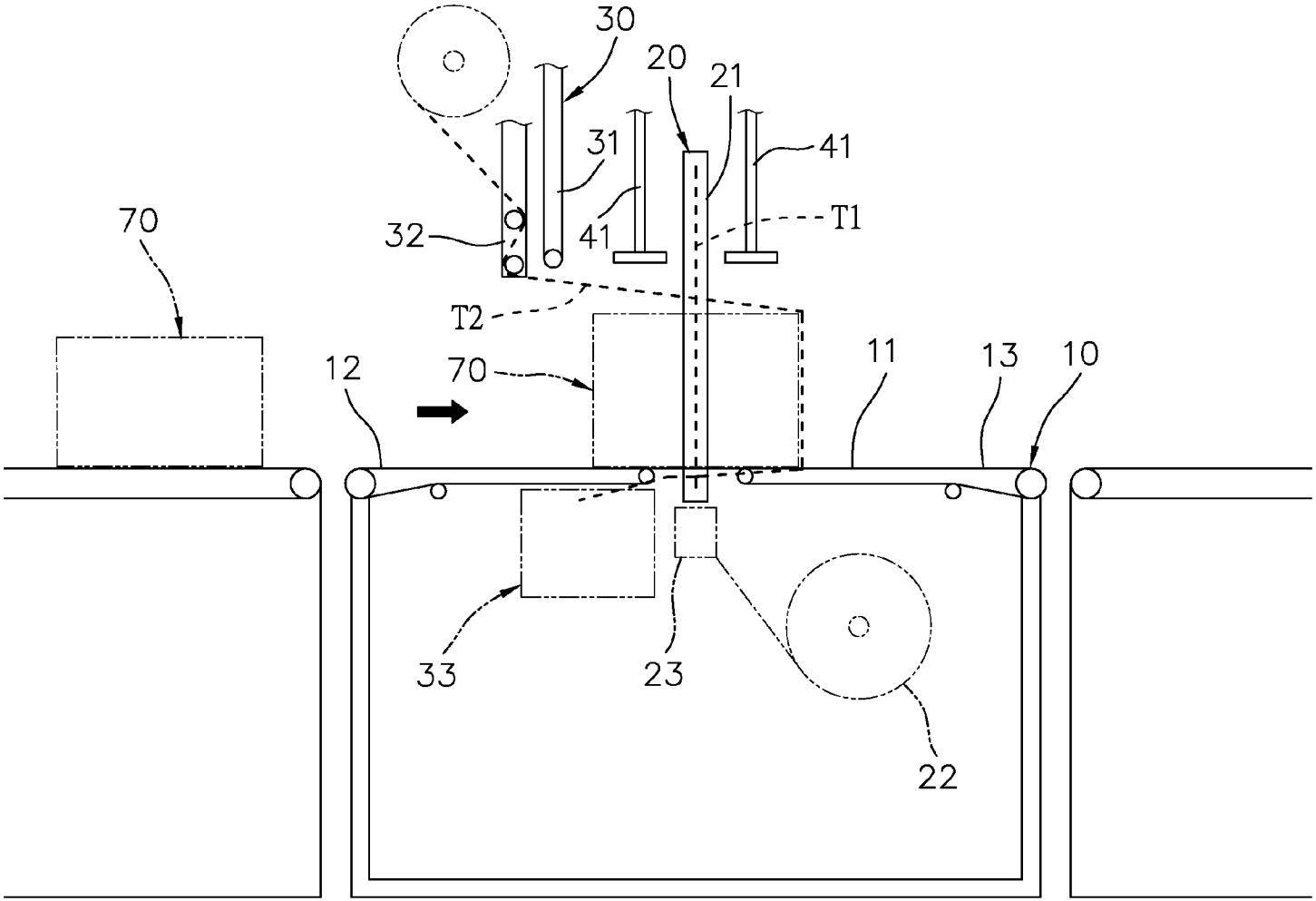
FIG. 5B is a schematic illustration showing that the object is moved on the working surface.

[b] As shown in FIG. 5B, the object 70 passes through the first end 12 and move in a zone on the working surface 11 of the base 10. When the object 70 moves in, the second strap T2 becomes bended and contacts with the object 70.

Figure 5C:
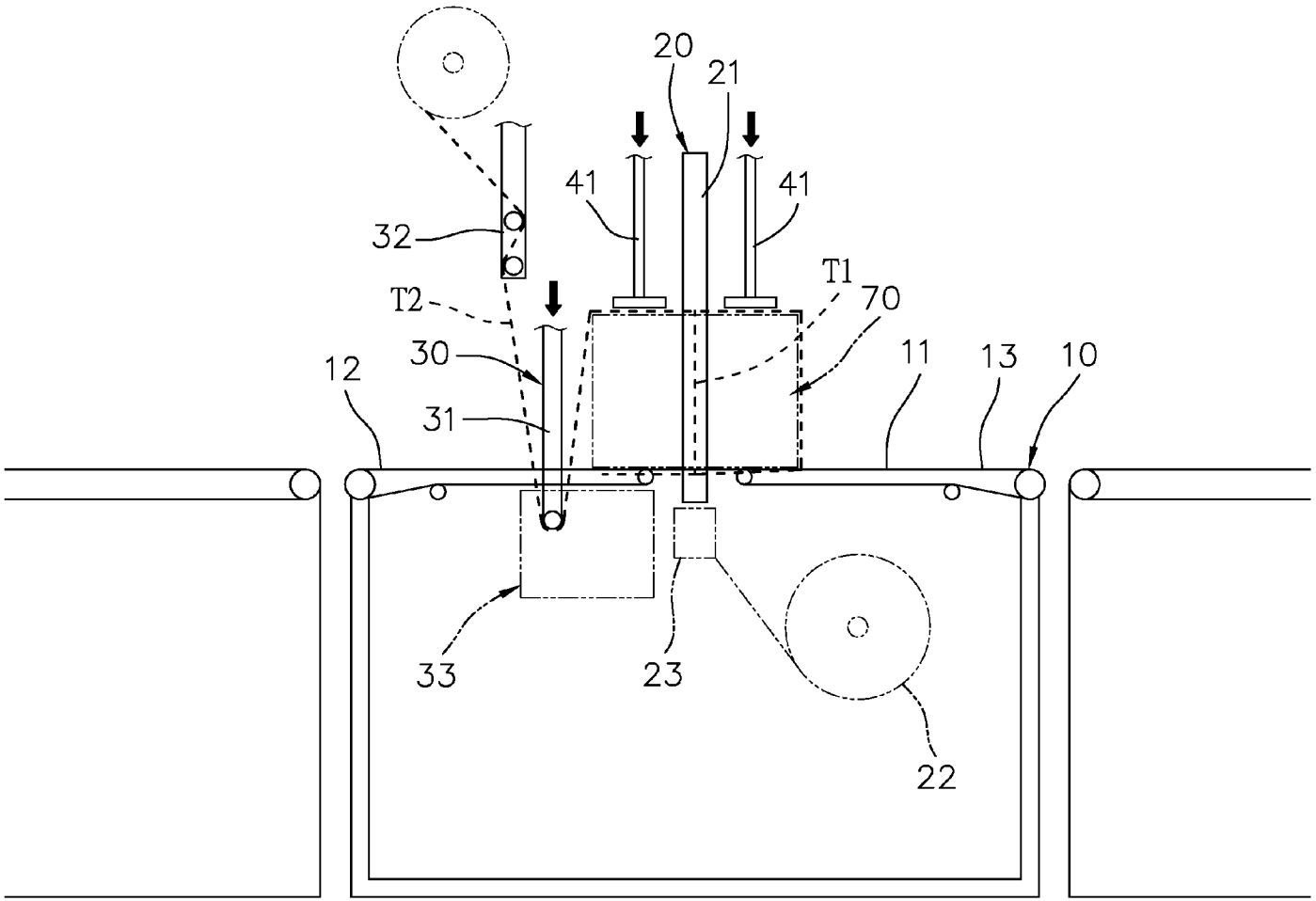
FIG. 5C is a schematic illustration showing that the lateral strapping procedure is done.

[c] As exhibited in FIG. 5C, the longitudinal guider 31 of the longitudinal strapping mechanism 30 moves down. Meanwhile, the first strap T1 of the lateral chute 21 of the lateral strapping mechanism 20 contracts so as to strap around the object's 70 top surface 71, bottom surface 72, and two sides 75. After which, the first sealing/cutting assembly 23 is used for sealing and cutting the first strap T1 (such sealing and cutting are conventional skills) so as to finish a lateral strapping procedure.

Figure 5D:
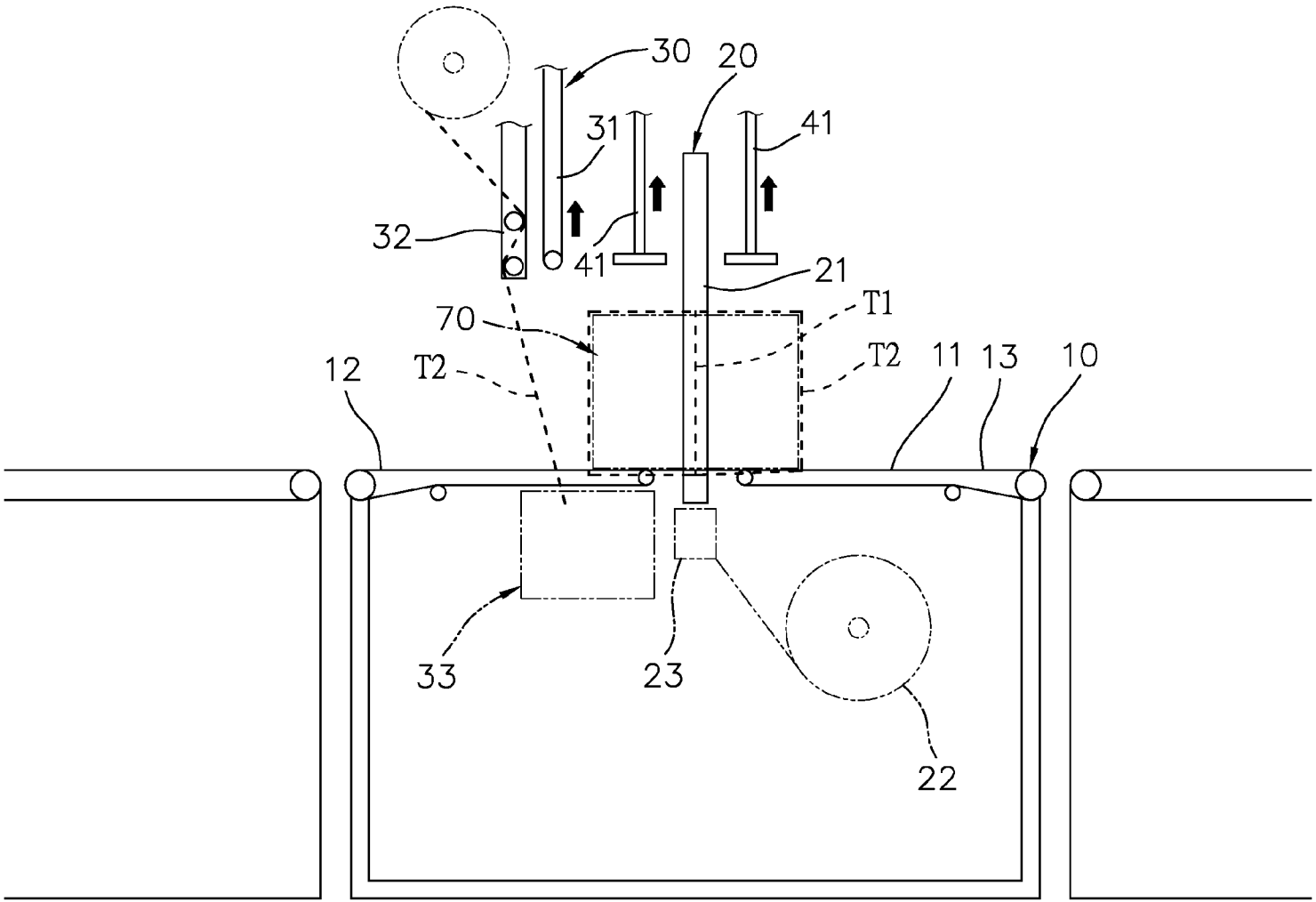
FIG. 5D is a schematic illustration showing that the longitudinal strapping procedure is done.

[d] As shown in FIG. 5D, by utilizing the second strap supplying assembly 32, the second strap T2 can be strapped around the object's 70 top surface 71, bottom surface 72, front surface 73 and rear surface 74. After the second sealing/cutting assembly 33 finishing the sealing and cutting works, the longitudinal strapping procedure for the second strap T2 is done.

Of course, this invention can further comprise a plurality of pressing boards 41 that can move up and down. When the pressing boards 41 move down, they press on the object 70 as shown in FIG. 5C. When the pressing boards 41 move up, they separate from the object 70 as shown in FIG. 5D.

Moreover, the details of the longitudinal strapping procedure are described below.

Figure 6B:
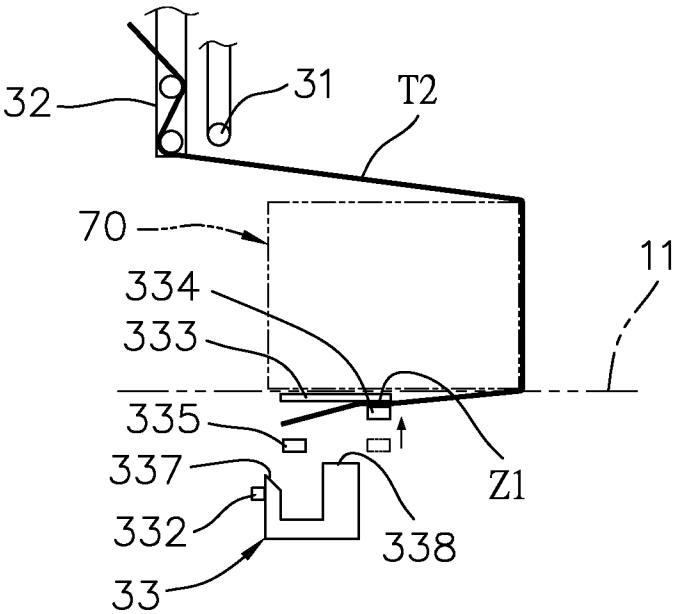
FIG. 6B is a view illustrating the process two of the longitudinal strapping.
Figure 6A:
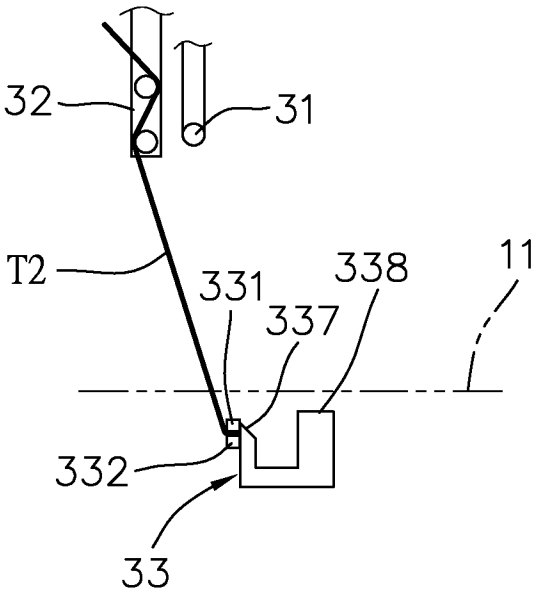
FIG. 6A is a view illustrating the process one of the longitudinal strapping.

As shown in FIG. 6A, the object 70 is not moved in yet. The second strap T2 is tilted. The first clamper 331 and the second clamper 332 clamp on an end of the second strap T2.

Referring to FIG. 6B, the object 70 is moved on the working surface 11. Also, the second strap T2 becomes bended and contacts with the object 70. Meanwhile, the third clamper 333, the third clamper 334, and the fifth clamper 335 move to a zone below the object 70. The fourth clamper 334 moves up to fix the second strap T2. Then, the first clamper 331 and the second clamper 332 release the second strap T2. The first clamper 331 move laterally for a distance (such condition is expressed by not showing in the Figure).

Figure 6D:
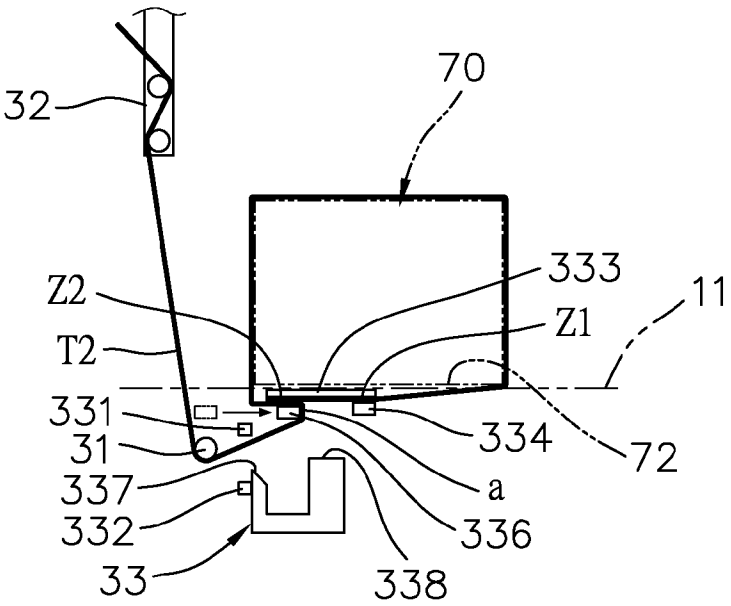
FIG. 6D is a view illustrating the process four of the longitudinal strapping.
Figure 6C:
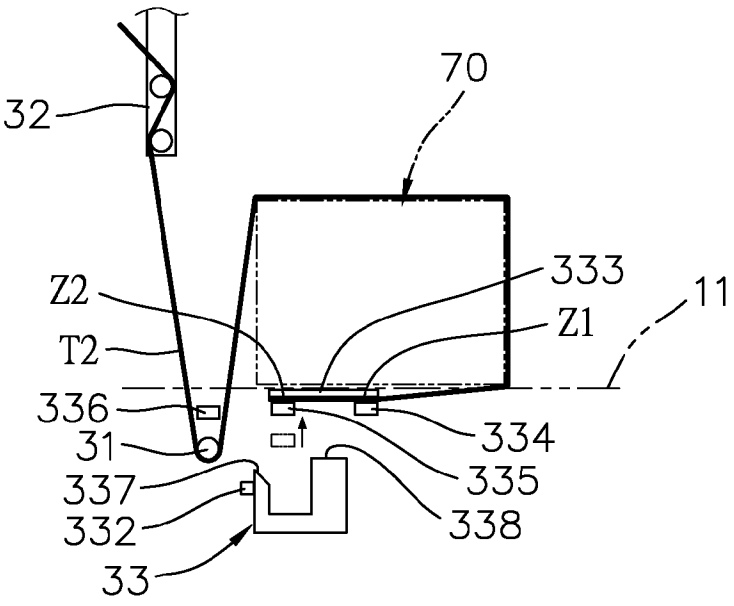
FIG. 6C is a view illustrating the process three of the longitudinal strapping.

As shown in FIG. 6C, the fifth clamper 335 moves up to press on the second strap T2. The longitudinal guider 31 of the longitudinal strapping mechanism 30 moves down and it also presses down the second strap T2. At this moment, the transverse guider 336 moves in to a position that is above the longitudinal guider 31 but still below the working surface 11.

As illustrated in FIG. 6D, the transverse guider 336 guides the second strap T2 bending below the bottom surface 72 of the object 70 as well as making the second strap T2 having an substantially overlapping portion so as to strap around the object 70 (one loop). In which, the fifth clamper 335 moves out, so it is not shown in the Figure. A being point a is formed on the second strap T2. Besides, the first clamper 331 returns to its original position.

Figure 6F:
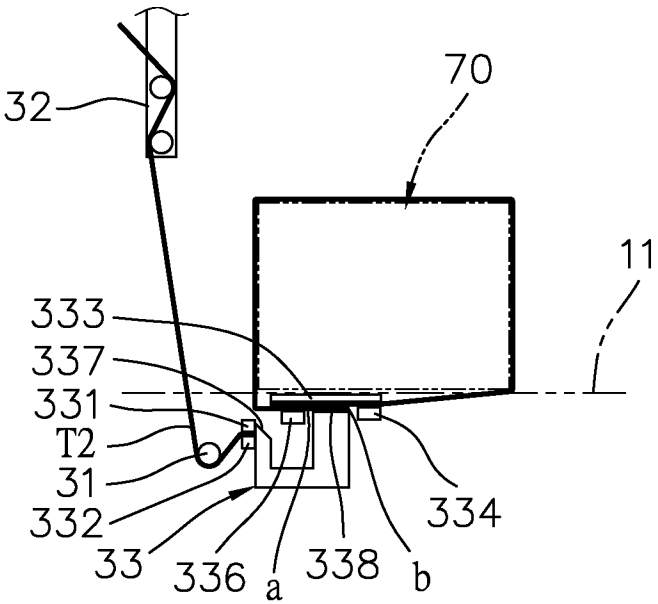
FIG. 6F is a view illustrating the process six of the longitudinal strapping.
Figure 6E:
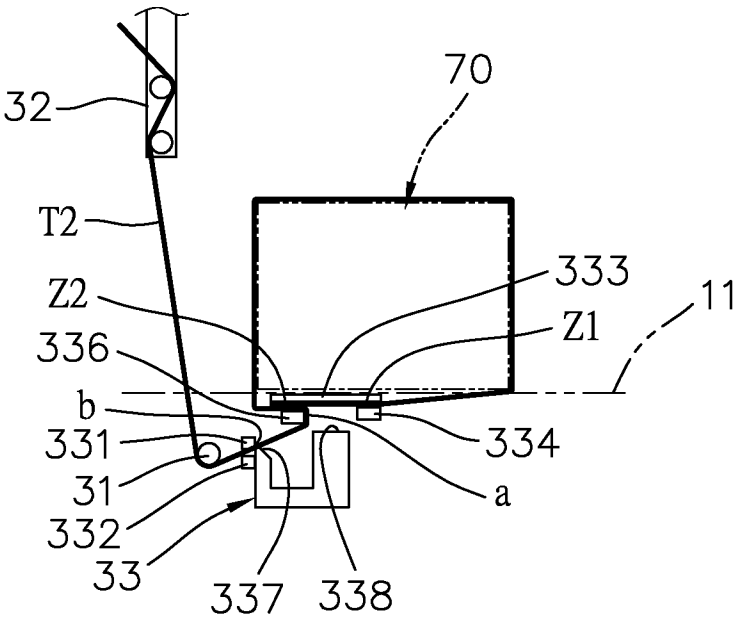
FIG. 6E is a view illustrating the process five of the longitudinal strapping.

Please see FIG. 6E, the first clamper 331 and the second clamper 332 clamp the end of the second strap T2. Meanwhile, the cutter 337 cuts out the strap T2, so that a cutting point b on the second strap t2 is formed.

Finally, as shown in FIG. 6F, when the transverse guider 336 moves horizontally, the cutting point b of the second strap T2 will move. Hence, this second strap T2 becomes substantially horizontal. After which, the thermal sealer 338 seals a part of this overlapped portion (such as the overlapped portion between bending point a and the cutting point b) of the second strap T2 so as to seal the second strap T2. The cutting/sealing procedure is completed. As last, the longitudinal guider 31 and the transverse guider 336 return to their original positions as well as the third clamper 333 and the fourth clamper 334 move out so as to repeat another new working cycle.

The advantages and functions of this invention can be summarized as follows.

[1] Both the lateral strapping procedure and the longitudinal strapping procedure can be done in only one machine. Because the lateral strapping procedure and the longitudinal strapping procedure can be completed in one machine, the overall process becomes simpler.

[2] The turn table is not required. The convention technology requires a turn table. But, such turn table is not required in this invention. Not only the space is saved, but also the cost of this turn table is saved.

The above embodiments are only used to illustrate the present invention, not intended to limit the scope thereof. Many modifications of the above embodiments can be made without departing from the spirit of the present invention.

What is claimed is:

1. A cross-strapping device comprising:

a base having a working surface, a first end, a second end, said working surface being provided for receiving an object thereon, said object having a top surface, a bottom surface, a front surface, a rear surface, and two sides;

a lateral strapping mechanism having a lateral chute, a first strap supplying assembly, and a first sealing/cutting assembly; said first strap supplying assembly is provided for supplying a first strap which is guided by said lateral chute and be strapped around said object's top surface, bottom surface, and two sides; said first sealing/cutting assembly being used for sealing and cutting said first strap so as to finish a lateral strapping procedure;

a longitudinal strapping mechanism having a longitudinal guider, a second strap supplying assembly, and a second sealing/cutting assembly; said second strap supplying assembly is provided for supplying a second strap which is guided by said longitudinal guider and be strapped around said object's top surface, bottom surface, front surface and rear surface; said second sealing/cutting assembly being used for sealing and cutting said second strap so as to finish a longitudinal strapping procedure;

so that said object is placed on a fixed working surface without rotation, as well as said lateral strapping procedure and said longitudinal strapping procedure are completed on the same working surface;

said longitudinal strapping mechanism comprises: a first clamper, a second clamper, a third clamper, a fourth clamper, a fifth clamper, a transverse guider, a cutter, and a thermal sealer; said first clamper and said second clamper being able to clamp/release an end of said second strap; said third and fourth clampers being able to move into/from a place below said bottom surface of said object; said third and fourth clampers being able to clamp/release a first portion of said second strap, said third clamper and said fifth clamper being able to clamp/release a second portion of said second strap; said transverse guider being provided for guiding said second strap bending below said bottom surface of said object as well as making said second strap having an substantially overlapping portion so as to strap around said object; said cutter being used for cutting said second strap; and said thermal sealer being provided for sealing a part of said overlapped portion so as to seal said second strap.

2. The cross-strapping device as defined in claim 1, further comprising a plurality of pressing board that can move up and down.

* * * * *